United States Patent [19]

Nazworth

[11] 3,939,503

[45] Feb. 24, 1976

[54] PORTABLE EMERGENCY SAFETY SHOWER

[76] Inventor: Harold W. Nazworth, Lake Charles, La. 70601

[22] Filed: Apr. 16, 1975

[21] Appl. No.: 568,690

[52] U.S. Cl. ..... 4/145; 4/147; 4/155; 4/156; 239/146; 239/165; 239/281; 239/373

[51] Int. Cl.[2]... B05B 9/04; B05B 13/02; A47K 3/22

[58] Field of Search ..... 239/146, 165, 176, 273, 239/275, 280–281, 286, 302, 308, 303, 307, 337, 372, 373; 4/145, 146, 147, 20, 151, 155, 156

[56] References Cited

UNITED STATES PATENTS

| | | | |
|---|---|---|---|
| 426,798 | 4/1890 | Grove | 4/156 |
| 1,302,559 | 5/1919 | Hynek | 4/155 |
| 2,776,168 | 1/1957 | Schweda | 4/145 X |
| 3,080,568 | 3/1963 | Burnett | 4/145 |
| 3,483,571 | 12/1969 | Cox | 4/145 |

FOREIGN PATENTS OR APPLICATIONS

| | | | |
|---|---|---|---|
| 544,031 | 6/1922 | France | 239/373 |
| 502,815 | 12/1954 | Italy | 4/146 |

*Primary Examiner*—Robert S. Ward, Jr.
*Attorney, Agent, or Firm*—George R. Douglas, Jr.

[57] ABSTRACT

A Portable Emergency Safety Shower having a large capacity water supply tank, a telescoping series of pipe elements having one end secured to the water supply tank and the other end connected to a shower head, a pressurized cylinder for the storage of air or nitrogen, valved coupling means for providing passage of a pressurized medium to the water supply tank for applying pressure to the water in said supply tank into the pipe elements to exit at the shower head for achieving the performance of a portable emergency safety shower.

4 Claims, 3 Drawing Figures

PORTABLE EMERGENCY SAFETY SHOWER

CROSS REFERENCE TO PRIOR ART AND PRIOR INFORMATION

This disclosure is an improvement over prior art systems and arrangements such as are found in the following patents taken singly or in combination:

| | |
|---|---|
| Barnett | 3,080,568 |
| Cox | 3,483,571 |

These patents are found as a result of a search conducted in Class 4, subclasses 145, 147, 148, 161 and 173. None of these various patents or others in these classification of patents show and exhibit the novel cooperative features of the invention.

BRIEF SUMMARY OF THE INVENTION

The invention relates to a compact and newly found combination of elements for an improved portable emergency safety shower; more particularly the invention relates to an apparatus for a manually operable, portably carried emergency and safety shower having uses of being relocated at will or in being carried about as desired for providing essential shower services whenever needed. It is within the purview and scope of the invention to provide apparatus of the invention to which hot or warm water may be provided for injection or inflow to a large capacity water tank before the water is exhausted from the shower head under the pressure supplied from the pressurized cylinder.

Also particularly within the scope of the invention is the provision of apparatus for measuring the pressure of the pressurized tank, for providing relief of overpressure conditions that may become to exist in the water supply tank and apparatus for allowing the supply line for the shower head to be constructed of a series of telescoping pipe elements that are capable of being arranged in collapsible array within the water supply tank.

FIELD OF THE INVENTION

It is within the context and purview of the present invention to provide a new and improved shower arrangement in which the apparatus thereof is constructed for portability, emergency use and for achieving safety to persons who may use it.

It is known that during emergencies caused by conditions of tornado, hurricanes and other catastrophies, that the usual available water supplies are interrupted and often these are not available as a result of these emergency situations, any cleansing or washing facilities that otherwise are usually available. The house facilities of many are rendered useless and commercial, hotel, motel facilities and the like are unavailable.

Therefore, it is an object and an advantage of the present invention to provide a safety, emergency and portable apparatus useful and movably available for cleansing, showering, washing and the like, and in which the device is safe by its inclusion of measuring means, over-pressure relief valves, and corrosion-proof tank linings for the water supply tank. The water supply tank can be constructed to contain 7 gallons, or more, or less.

It is another object and advantage of the invention to provide a non-clog, deluge-type shower head for effecting maximized cleaning and showering.

Another object of the invention is to provide means for carrying the portable shower apparatus of the invention, especially for providing portability when the water supply tank is empty or near empty by the use of handle means affixed to the water supply tank.

BRIEF DESCRIPTION OF THE SEVERAL FIGURES OF THE DRAWINGS

The above and other objects and advantages of the invention will become apparent upon full consideration of the following detailed description and accompanying drawings in which.

DETAILED DESCRIPTION OF THE INVENTION

Figure 1:
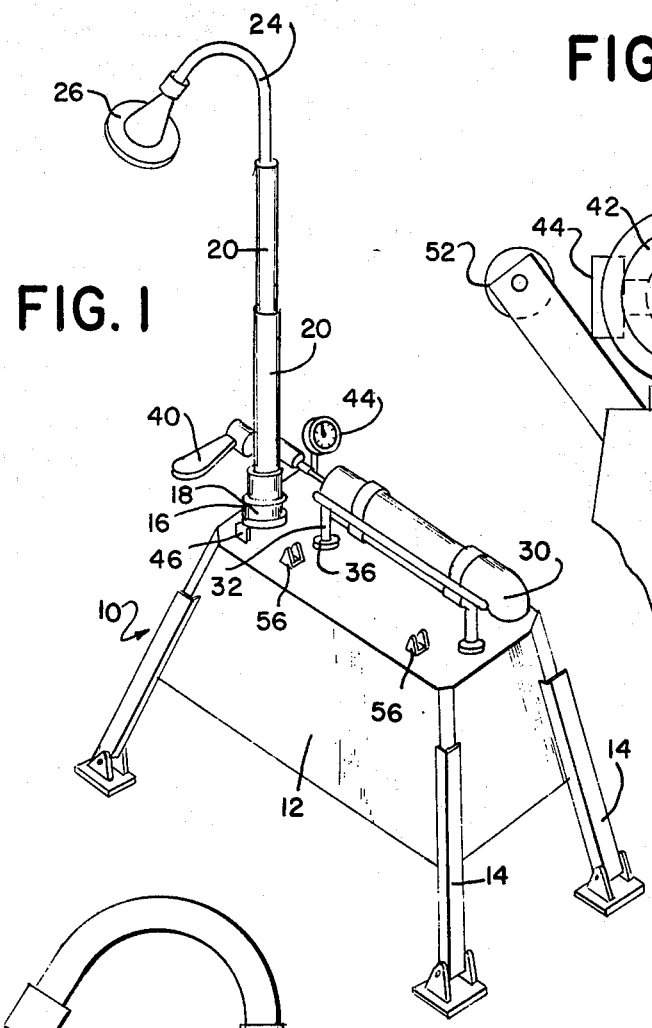
FIG. 1 is a generally upper and front perspective view of a portable emergency safety shower apparatus according to one of the preferred and best modes of the present invention.
Figure 2:
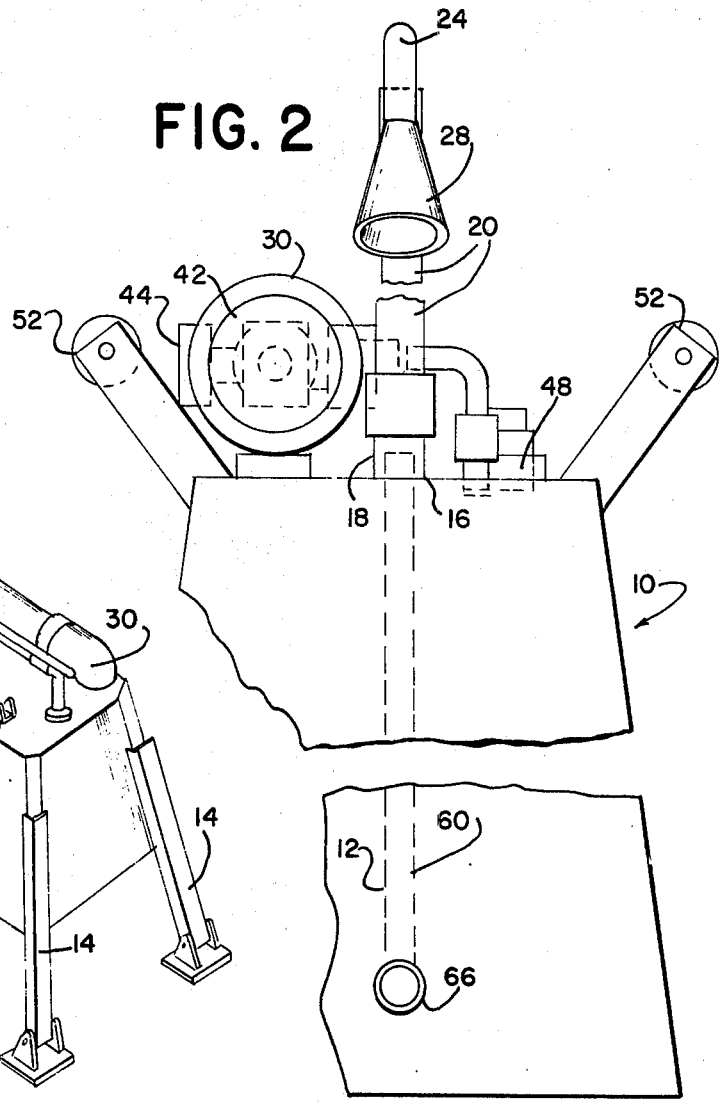
FIG. 2 is an end view on an enlarged scale relative to that of FIG. 1 showing a different embodiment, partly broken away and constituting another preferred embodiment of the invention.
Figure 3:
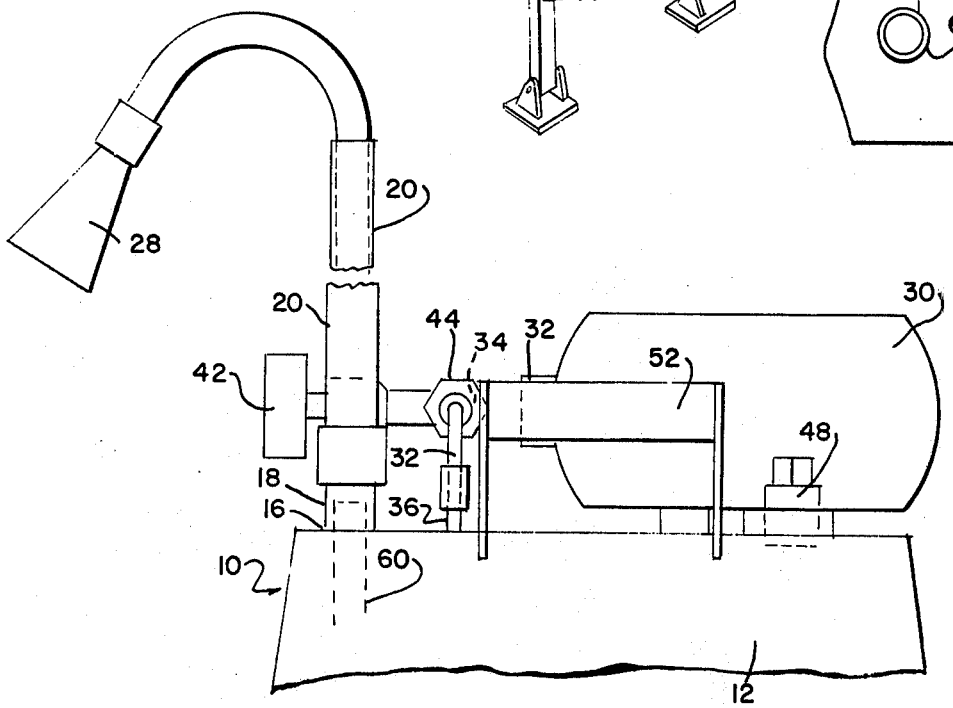
FIG. 3 is a front view of an embodiment such as shown in FIG. 2.

Referring now to the drawings, there is shown in FIGS. 1–3 a portable emergency safety shower apparatus 10 having a large capacity water tank 12 in which its inner and outer surfaces are rust-resistant to water and corrosion proof, as is a well-known expedient such as by having a coating or constructed of material such as plate steel, or the like. From the four extremities of the water tank 12 and extending generally downwardly are respectively self-storing leg elements 14 that are adjustable in length for supporting the water tank at selected distances from its supporting ground (not shown).

From the top of the water tank 12 and at a tank opening 16 in the surface of the tank is a coupling member 18 securely connected to the tank opening 16 to which is threadedly coupled in a secure fashion a telescoping series of pipe elements 20, 20. The large diameter of the series is affixed to the coupling member 18. The small diameter of the series is at the other end to which there is coupled in conventional manner a curved pipe connection 24 extending from the small diameter end of the series of the pipe elements 20, 20. The curved pipe connection 24 terminates in a deluge shower head 26 as the type shown in FIG. 1 or a deluge shower head 28 as shown in FIGS. 2 & 3.

There is mounted on the upper surface of the water tank 12 a water tank pressurization cylinder or a pressurized cylinder 30 for providing under high pressures for the storage of gas such as air or nitrogen ($N_2$) therein. A valved pipe or conduit 32 connects an orifice 34 to a nipple 36 in the water tank 12 so that there is an integral and air tight passage from the pressurized cylinder to the water tank, but as controlled by a manually operable valve 40 (FIG. 1) to selectively release and shut off the passage of high pressure gas from the pressurized cylinder to the water supply tank.

FIGS. 2 and 3 show a disk-type valve handle 42 for the manually operable valve while FIG. 1 shows a turn arm or crank for the valve 40.

A pressure gage 44 is provided connected in the regulator and valved conduit 32 to indicate the high pressure valve of the gas in the cylinder 30.

The water tank is filled with water whether hot or at room temperature, or otherwise at fill point 46 in FIG. 1 or at fill point 48 in FIGS. 2 and 3.

In FIG. 1 is shown a handle 50 for carrying the shower apparatus 10 while an arrangement of a pair of handles 52, 52 are shown in FIGS. 2 and 3.

The water tank is filled by a supply line (not shown) but may be secured in place by supply line storage clips 56, 56 (FIG. 1).

It should be described that the series of pipe elements 20, 20 may be collapsed to be stored within the water tank 12.

To expend the water in the water tank from the shower head 26 or 28, the valve manually operable by handle 40 or 42 is turned to release gas from the pressurized cylinder 30 through the valved conduit 32 to the water tank so that the water in the tank under pressure is driven through a dip pipe 60 (FIGS. 2 & 3) to pass through the telescoping series of pipes 20, 20 to the shower head.

The water tank is capable of being drained from tank drain 66 (FIG. 2).

The apparatus of the invention provides a method and function of safety and health means of providing shower during times of distress and emergency such as after floods, hurricanes and the like. It provides portability as is needed in such circumstances during these forms or types of emergencies.

Additional embodiments of the invention in this specification will occur to others, and therefore it is intended that the scope of the invention be limited only by the appended claims and not by the embodiment(s) described hereinabove. Accordingly, reference should be made to the following claims in determining the full scope of the invention.

What is claimed is:

1. A portable emergency safety shower comprising a large capacity water supply tank having water-resistant, corrosion-proof, inner and outer surfaces thereof, leg elements extending from the supply tank for supporting said tank, a telescoping series of pipe elements having its large diameter terminal securely connected to an outlet in the upper surface of said tank and having elements of the telescoping series when in the collapsed form positioned within the tank and when in the extended arrangement positioned upwardly from the tank in a generally vertical alignment so that its small diameter terminal is above the tank, a curved pipe connection extending from the small diameter terminal to a shower head element, a pressurized cylinder for storage of air or nitrogen under high pressures therein and being mounted upon a portion of the water supply tank, and a valved conduit connecting said pressurized cylinder to the water supply tank including a manual valve to selectively release and shut off the passage of high pressure gas such as air or nitrogen from the pressurized cylinder to the water supply tank for in turn driving water into the water supply tank through the telescoping series of pipe elements and the shower head element.

2. The invention of claim 1 wherein said valved conduit has a pressure gage coupled to the line.

3. The invention of claim 1 wherein said water supply tank has a tank drain coupling member and a tank-fill closure means, each constructed to contain the water under said high pressure, and a tank-fill closure including means to relieve the high pressure within the water supply tank automatically when it exceeds a certain valve of said high pressure and manual means to also relieve the high pressure within the water supply tank.

4. The invention of claim 1 wherein said manual valve provides activation of the emergency safety shower when said air or nitrogen under said high pressure is released from said pressurized tank.

* * * * *